US009987730B2

(12) United States Patent
Pearl, II et al.

(10) Patent No.: US 9,987,730 B2
(45) Date of Patent: Jun. 5, 2018

(54) DUAL FUNCTION ADAPTER AND METHOD

(71) Applicant: Uniweld Products, Inc., Fort Lauderdale, FL (US)

(72) Inventors: David S. Pearl, II, Fort Lauderdale, FL (US); Douglas B. Pearl, Hollywood, FL (US); David Foster, Plantation, FL (US); Dragan Bukur, Fort Lauderdale, FL (US)

(73) Assignee: Uniweld Products, Inc., Fort Lauderdale, FL (US)

( * ) Notice: Subject to any disclaimer, the term of this patent is extended or adjusted under 35 U.S.C. 154(b) by 292 days.

(21) Appl. No.: 14/883,746

(22) Filed: Oct. 15, 2015

(65) Prior Publication Data

US 2017/0106506 A1 Apr. 20, 2017

(51) Int. Cl.

| | |
|---|---|
| ***B25B 13/48*** | (2006.01) |
| ***B25B 13/46*** | (2006.01) |
| ***B25B 15/00*** | (2006.01) |

(52) U.S. Cl.

CPC ..... *B25B 15/008* (2013.01); *B25B 13/463* (2013.01)

(58) Field of Classification Search

CPC ... B25B 13/58; B25B 13/463; B25B 23/0035; B25B 15/008; B25B 15/04; B25B 15/001

See application file for complete search history.

(56) References Cited

U.S. PATENT DOCUMENTS

| | | | | |
|---|---|---|---|---|
| 1,578,065 | A * | 3/1926 | Bemus | B25B 13/463 81/177.2 |
| 3,875,829 | A * | 4/1975 | Evans | B25B 13/06 81/177.2 |
| 4,436,005 | A * | 3/1984 | Hanson | B25B 13/481 81/177.75 |
| 5,860,338 | A * | 1/1999 | Littlefield | B25B 15/001 81/177.2 |
| 6,352,011 | B1 * | 3/2002 | Fruhm | B25B 15/001 81/436 |
| 6,418,821 | B1 * | 7/2002 | Yamakawa | B25B 13/06 81/124.6 |
| 6,550,358 | B1 | 4/2003 | Martin | |
| 6,782,777 | B1 * | 8/2004 | Wei | B25B 23/0035 81/177.85 |
| 9,032,847 | B2 * | 5/2015 | Duitsman | B25B 15/001 81/438 |
| 9,498,870 | B2 * | 11/2016 | Davis | B25B 13/56 |
| 2002/0011135 | A1 | 1/2002 | Hall | |

(Continued)

OTHER PUBLICATIONS

Uniweld Offset Ratchet Wrench with hex adapter, 2010.

*Primary Examiner* — David B Thomas

(74) *Attorney, Agent, or Firm* — Nields, Lemack & Frame, LLC

(57) ABSTRACT

An adapter comprising an elongated member having an intermediate body region to be received by a tool in locking engagement, a first region extending in a first direction axially from the intermediate body region and having a first keyed free end having a cross-section of a first size, and a second region extending axially from the intermediate body region in a second direction opposite the first direction and having a second keyed free end having a cross section of a second size different from the first size. The adapter can be used to actuate sockets of different size.

5 Claims, 3 Drawing Sheets

(56) References Cited

U.S. PATENT DOCUMENTS

| | | | | |
|---|---|---|---|---|
| 2003/0126957 | A1* | 7/2003 | Huang | B25B 13/463 81/60 |
| 2003/0188609 | A1* | 10/2003 | Crawley | B25B 7/02 81/439 |
| 2006/0130621 | A1* | 6/2006 | Novak | B25B 15/001 81/439 |
| 2009/0151515 | A1* | 6/2009 | Veltri | B25B 15/008 81/52 |
| 2010/0011914 | A1* | 1/2010 | Ming-Chi | B25B 13/14 81/60 |
| 2014/0116210 | A1* | 5/2014 | Lukes | B25B 15/004 81/436 |
| 2015/0052686 | A1* | 2/2015 | Davis | B25B 13/56 7/165 |
| 2016/0059394 | A1* | 3/2016 | Hu | B25B 23/0035 81/60 |
| 2016/0354918 | A1* | 12/2016 | Wang | B25G 3/22 |
| 2017/0014978 | A1* | 1/2017 | Chen | B25B 15/001 |

* cited by examiner

DUAL FUNCTION ADAPTER AND METHOD

BACKGROUND

Mechanical air conditioning and refrigeration is accomplished by continuously circulating, evaporating, and condensing a fixed supply of refrigerant in a closed system. Charging or recharging an air conditioning or refrigeration system with refrigerant is done through the low side suction intake fitting with the use of manifold gauges and service hoses. Low-pressure vapor refrigerant is compressed and discharged from a compressor as a high temperature, high-pressure, "superheated" vapor or liquid. The high-pressure refrigerant flows to a condenser, where it is changed to a low temperature, high-pressure liquid. It then flows through a filter dryer to a thermal expansion valve or TXV. The TXV meters the correct amount of liquid refrigerant into an evaporator. As the TXV meters the refrigerant, the high-pressure liquid changes to a low pressure, low temperature, saturated liquid/vapor. This saturated liquid/vapor enters the evaporator and is changed to a low pressure, dry vapor. The low pressure, dry vapor is then returned to the compressor. The cycle then repeats.

The manifold commonly has three refrigeration lines or hoses connected thereto. One line is connected through the manifold to a low pressure gauge and is used in servicing the low pressure side (suction side) of a refrigeration/air conditioning system. A second line is connected through the manifold to a high pressure gauge and is used in servicing the high pressure side (discharge side) of a refrigeration/air conditioning system. A third line is connected to a port which commonly connects the ports in the manifold leading to the high and low pressure lines. The third line is used for connection to a refrigerant source or some other pressurized source, or a vacuum source.

Flow control is performed by means of high pressure and low pressure valves at the manifold. Whenever any of the aforementioned three lines are connected to a refrigeration or air conditioning system, the lines can be bled to purge the air from the lines so as to avoid contamination of the refrigeration system with air (and moisture in that air).

Many refrigeration compressors incorporate a suction service valve and a discharge service valve. These are used to allow refrigeration gauges to be attached to the system; and, if needed, they are used to isolate the compressor from the rest of the system. Typically the low pressure (suction side) valve and high pressure (liquid side) valve differ in construction. These service valves each include recessed safety sockets that can be opened or closed with a standard refrigeration service wrench, but require different size hex key adapters to do so. For example, a $3/16^{th}$ inch hex key is operable to open and close the high side service valve, while a $5/16^{th}$ inch hex key is operable to open and close the low side service valve.

A conventional hex key adapter that is capable of opening and closing both the high side and low side valves may be a stacked adapter; it includes a distal end that is keyed to the low side valve socket, and a middle portion that is keyed to the high side valve socket. Difficulties arise, however, because the length of the distal end key must be sufficient to operatively connect with the low side valve, but not be so long as to prevent the middle portion from operatively connecting to the high side valve. In fact, the tolerance is so tight that often the technician strips the high side valve because the hex key barely reaches the hex socket, does not become fully engaged in that socket, and upon attempted rotation, strips the socket. Shortening the length of the distal end allows the middle portion to reach the socket effectively, but may result in the distal end key not effectively reaching its corresponding hex socket, and thus stripping the same upon attempted rotation.

It therefore would be desirable to provide an adapter that is operable to open and close both the low side valve and high side valve while reducing or eliminating the risk of stripping one or more of the valves.

Other objects and advantages of the present invention and advantageous features thereof will become apparent as the description proceeds herein.

SUMMARY

Problems of the prior art have been addressed by the embodiments disclosed herein, which relate to an adapter comprising an elongated member having an intermediate body region to be received by a tool in locking engagement, a first region extending in a first direction axially from said intermediate body region and having a first keyed free end having a cross-section of a first size, and a second region extending axially from said intermediate body region in a second direction opposite said first direction and having a second keyed free end having a cross section of a second size different from said first size.

In certain embodiments, the intermediate body region comprises a square cross-section keyed to be received by a hand-held tool. In certain embodiments, the keyed region of the intermediate body region comprises a roller partially embedded therein and protruding therefrom. In certain embodiments, the first keyed free end has a hexagonal cross-section. In certain embodiments, the second keyed free end has a hexagonal cross-section.

In its method aspects, embodiments disclosed herein relate to actuating first and second sockets of different sizes, comprising: providing an adapter comprising an elongated member having an intermediate body region to be received by a tool in locking engagement, a first region extending in a first direction axially from the intermediate body region and having a first keyed free end having a cross-section of a first size, and a second region extending axially from the intermediate body region in a second direction opposite the first direction and having a second keyed free end having a cross section of a second size different from the first size; providing a tool for engaging the adapter, such as a wrench; engaging the adapter in the tool by securing the intermediate body region therein; inserting the first keyed free end into the first socket; actuating the first socket with the tool such as by relative rotation of the tool with respect to the socket; removing the first keyed free end from the first socket; inserting the second keyed free end into the second socket; and actuating the second socket with the tool, again such as by relative rotation of the tool with respect to the socket.

DETAILED DESCRIPTION

Figure 1:
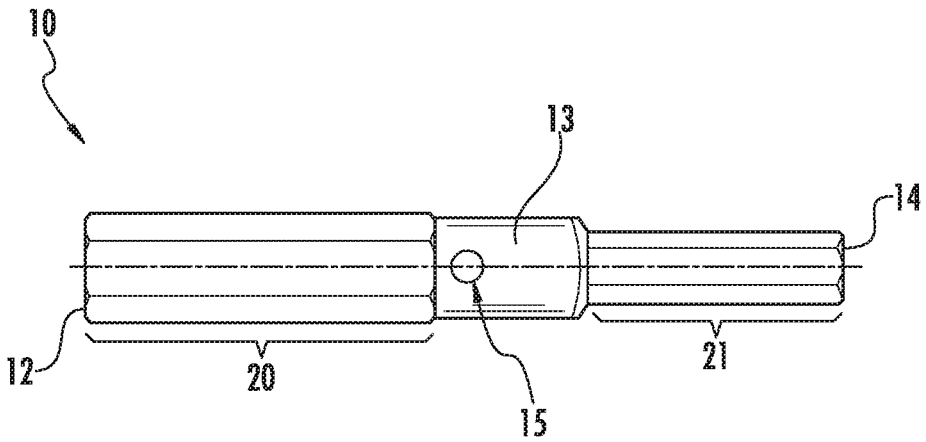
FIG. 1 is a side view of an adapter in accordance with certain embodiments.

Turning now to FIG. 1, there is shown an adapter 10 in accordance with certain embodiments. An intermediate body region 13 is positioned between the first region 20 and the second region 21. In certain embodiments, the adapter 10 is an elongated member, having a first region 20 with a first free end 12 having a first diameter and a second region 21 with a second free end 14 having a second diameter, wherein the first and second diameters are different. In certain embodiments, the first and second free ends 12, 14 are hex keys, and thus are dimensioned in accordance with conventional hex key sizes. For example, for a $5/16^{th}$ inch hex key, the hex width across the flats is between 0.312 and 0.3125 inches, while for a $3/16^{th}$ inch hex key, the hex width across the flats is between 0.188 and 0.1875 inches. Hex key sizes are classified in accordance with ANSI/ASME standard B18.3-1998, the disclosure of which is incorporated herein by reference. In certain embodiments, the first and second free ends 12, 14 have other cross-sectional shapes, such as a six-point star-shaped pattern (TORX).

Figure 3:
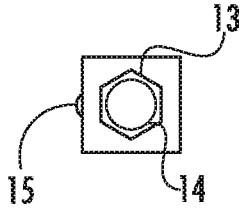
FIG. 3 is a front view of the adapter of FIG. 1.

In certain embodiments, the intermediate body region 13 is configured to be received by a tool 50 for gripping the adapter 10 and turning the adapter, such as a hand-operated ratchet wrench (FIG. 4) having a ratcheting mechanism 51 and a handle 52 attached thereto. An offset ratchet wrench 50' (FIG. 5) also could be used where the handle 51' is angled (e.g., acute or obtuse) with respect to the operative member (e.g., the ratchet mechanism 51) of the tool. In certain embodiments, the intermediate body region 13 has a square cross-section, as seen in FIG. 3, having an outside diameter slightly less than the inside diameter of an aperture in the ratcheting mechanism 51 of the tool 50 in which it is received, thereby allowing the adapter 10 to be received and held within the ratcheting mechanism 51. Those skilled in the art will appreciate that other shapes for the intermediate body region 13 are within the scope of the embodiments disclosed herein, provided that the shape corresponds to the shape of the ratchet mechanism or other operative member of the tool so that the intermediate body region 13 can be received and held by the tool.

In certain embodiments, the adapter 10, and in particular, the intermediate body region 13, can include a locking mechanism 15 that secures the adapter 10 in the ratcheting mechanism 51. In some embodiments, the locking mechanism 15 includes a spring loaded ball that protrudes axially from the intermediate body region 13, and is biased axially outwardly by the spring. When the adapter 10 is inserted into a ratcheting mechanism 51, such as an aperture matching the shape of the intermediate body region 13, the ball is biased axially inwardly against the force of the spring, and presses against a side wall of the ratcheting mechanism hole to help retain the adapter 10 in place in the tool 50.

Figure 2:
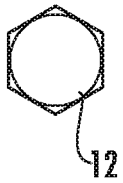
FIG. 2 is a rear view of the adapter of FIG. 1.

In certain embodiments, extending axially from a first end of the intermediate body region 13 is the first region 20. In certain embodiments, the first region 20 is integral with the intermediate body region 13, and terminates in free end 12. In certain embodiments, the free end 12 has a hexagonal cross-section as shown in FIG. 2, and thus forms a hex key dimensioned to interface with a corresponding hexagonal socket (not shown). Although a sufficient axial length (e.g., the length of the first region 20 operative to effectively engage and operate a corresponding socket) of the first region 20 should be hexagonal in cross-section to properly engage and actuate (e.g., rotate) the corresponding hex socket, those skilled in the art will appreciate that the entire length of the first region 20 may be of hexagonal cross-section for ease of manufacture. The overall axial length of the first region 20 should be sufficient to reach the socket to be actuated when the adapter is held by the tool via the intermediate body region 13.

In certain embodiments, extending axially from a second end of the intermediate body region 13 is the second region 21. In certain embodiments, the second region 21 is integral with the intermediate body region 13, and terminates in free end 14. In certain embodiments, the free end 14 has a hexagonal cross-section as shown in FIG. 3, and thus forms a hex key dimensioned to interface with a corresponding hexagonal socket (not shown). Although a sufficient axial length (e.g., the length of the second region 21 operative to effectively engage and actuate a corresponding socket) of the second region 21 should be hexagonal in cross-section to properly engage and actuate the corresponding hex socket, those skilled in the art will appreciate that the entire length of the second region 21 may be of hexagonal cross-section for ease of manufacture. The overall axial length of the second region 21 should be sufficient to reach the socket to be actuated when the adapter is held by the tool via the intermediate body region 13.

In certain embodiments, the first region 20 extends axially from the intermediate body region 13 in a direction opposite, e.g., 180°, to the direction in which the second region 21 extends axially from the intermediate body region 13.

The intermediate body region 13 is operative to be received by, and operated with, a tool 50 such as a manual ratchet wrench. It is not configured to itself be received by and operate a socket. In contrast, each first region 20 and second region 21 is keyed, such as via their hexagonal shapes, and is operative to be received by and operate a corresponding socket, but not be received by the tool.

Figure 4:
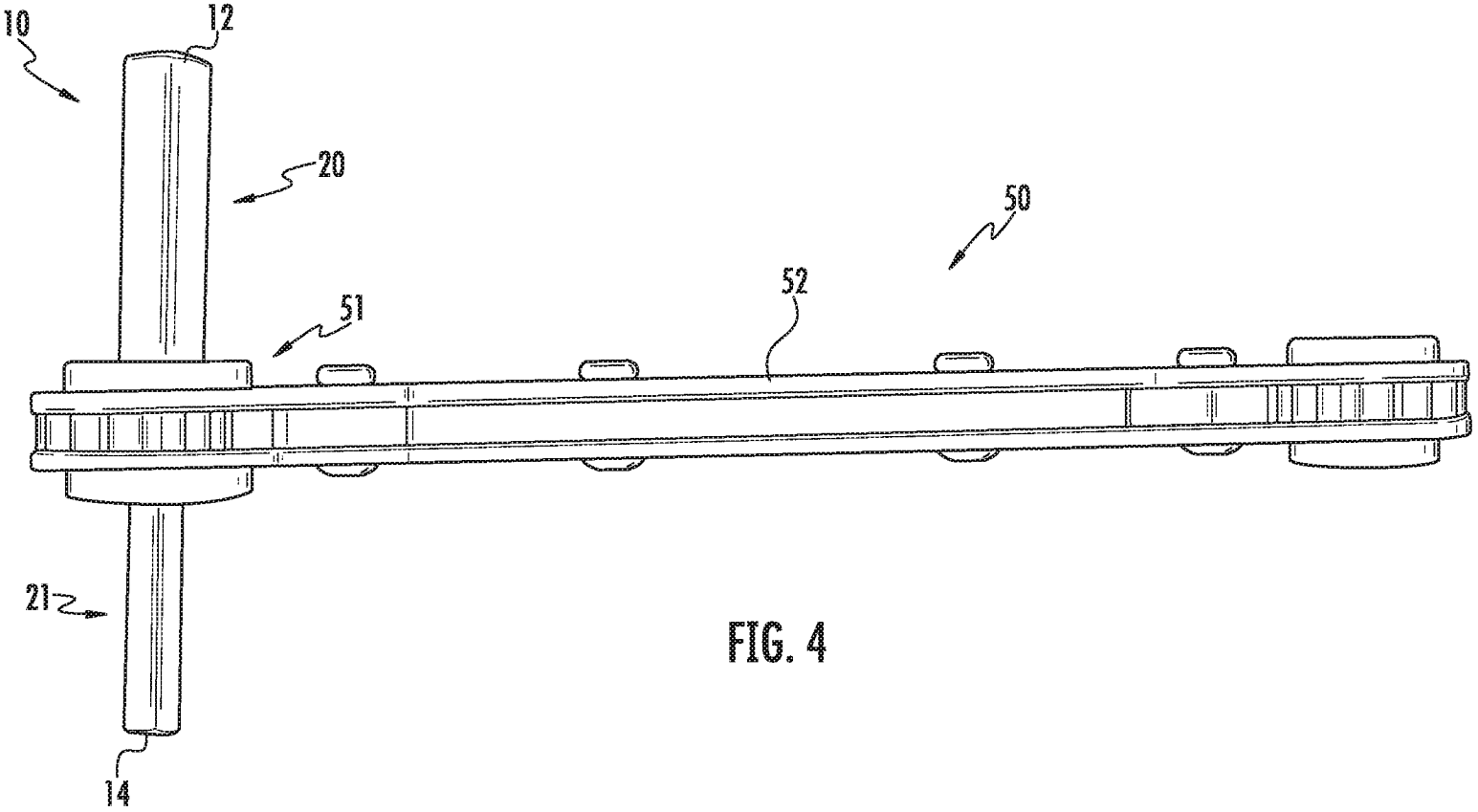
FIG. 4 is a perspective view of an adapter engaged with a hand tool in accordance with certain embodiments.
Figure 5:
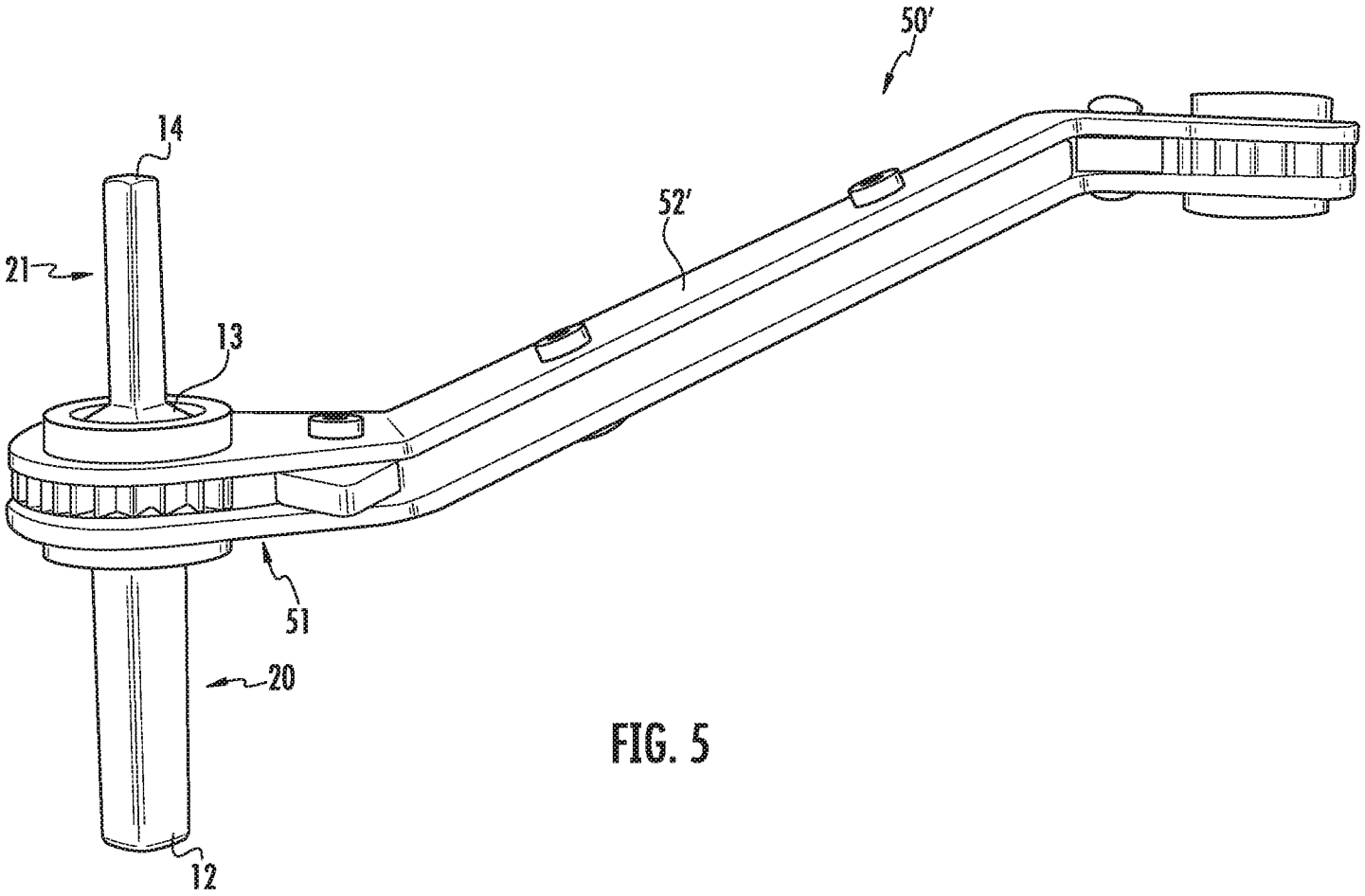
FIG. 5 is a perspective view of an adapter engaged with a reversible offset wrench in accordance with certain embodiments.

In certain embodiments, the adapter 10 is used for opening and closing service valves in air conditioning equipment. Exemplary dimensions for such an application include the first end 12 having a hex width across the flats of about 0.312 inches, the first region 20 having an axial length of about 1.162 inches, the second end 14 having a hex width across the flats of about 0.186 inches, and the second region 21 having an axial length of about 0.851 inches. The intermediate body region 13 has an axial length of about 0.518 inches in this embodiment. These dimensions have been found to be suitable for proper engagement of the intermediate body region 13 of the adapter 10 in a ratchet wrench, as shown in FIG. 4, and of suitable lengths so that the first region 20 and second region 21 are able to each effectively reach, engage and operate a respective socket in a service valve without removing the adapter 10 from the tool 50.

A further advantage of positioning the intermediate body region 13 between the functional ends 12 and 14 is the ability to use an offset ratchet wrench with the offset handle sloping up or down e.g., easily reversing the offset ratchet wrench by disengaging it from the adapter 10, turning it 180°, and re-engaging it with the adapter 10.

Embodiments disclosed herein also relate to a method of actuating keyed sockets of different dimensions by providing an adapter comprising an elongated member having an intermediate body region to be received by a tool in locking engagement, a first region extending in a first direction axially from the intermediate body region and having a first keyed free end having a cross-section of a first size, and a second region extending axially from the intermediate body region in a second direction opposite the first direction and having a second keyed free end having a cross section of a second size different from the first size; engaging the adapter in a tool such as a wrench by securing the intermediate body region in the tool; inserting the first keyed free end into a corresponding socket; actuating the socket with the tool; removing the first keyed free end from the corresponding socket; inserting the second keyed free end into a corresponding socket; and actuating the socket with the tool. In certain embodiments, the sockets are actuated by relative rotation between the socket and the adapter. In certain embodiments, the tool is a ratchet wrench. In certain embodiments, the sockets comprise valves that are actuated by opening or closing them. In certain embodiments, the tool (and adapter) are rotated 180° about an axis perpendicular to the longitudinal axis of the adapter after the first keyed free end is removed from its corresponding socket and prior to inserting the second keyed free end into its corresponding socket.

What is claimed is:

1. A method of actuating first and second sockets of different size of respective first and second service valves of an air conditioning or refrigeration system, comprising:

a. providing an adapter comprising an elongated member having an intermediate body region to be received by a tool in locking engagement, a first region extending in a first direction axially from said intermediate body region and having a first keyed free end having a cross-section of a first size, and a second region extending axially from said intermediate body region in a second direction opposite said first direction and having a second keyed free end having a cross section of a second size different from said first size, said intermediate body region having a spring-loaded ball protruding axially therefrom;

b. providing a tool for engaging said adapter;

c. engaging said adapter in said tool by securing said intermediate body region in said tool by actuating said spring loaded ball;

d. inserting said first keyed free end into said first socket of said first service valve;

e. actuating said first socket with said tool; removing said first keyed free end from said first socket;

f. inserting said second keyed free end into said second socket of said second service valve; and g. actuating said second socket with said tool.

2. The method of claim 1, wherein said took is a ratchet wrench.

3. The method of claim 2, wherein said tool is an offset ratchet wrench.

4. The method of claim 1, wherein said first and second keyed ends are hex keys.

5. The method of claim 1, wherein said intermediate body portion has a square cross-section.

* * * * *